US007934999B2

(12) United States Patent
Cackett et al.

(10) Patent No.: US 7,934,999 B2
(45) Date of Patent: May 3, 2011

(54) WOOD-TYPE GOLF CLUB HEAD WITH ADJUSTABLE SOLE CONTOUR

(75) Inventors: Matthew T. Cackett, San Diego, CA (US); D. Clayton Evans, San Marcos, CA (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 226 days.

(21) Appl. No.: 12/467,891

(22) Filed: May 18, 2009

(65) Prior Publication Data

US 2010/0292018 A1 Nov. 18, 2010

(51) Int. Cl.
*A63B 69/36* (2006.01)

(52) U.S. Cl. ..... 473/242; 473/244; 473/246; 473/248

(58) Field of Classification Search ..... 473/324–350, 473/244–248, 242
See application file for complete search history.

(56) References Cited

U.S. PATENT DOCUMENTS

| | | | |
|---|---|---|---|
| 782,955 | A | 2/1905 | Emens |
| 796,802 | A | 8/1905 | Brown |
| 1,222,770 | A | 4/1917 | Kaye |
| 1,249,127 | A | 12/1917 | Lard |
| 1,250,301 | A | 12/1917 | Goodrich |
| 1,454,267 | A | 5/1923 | Challis et al. |
| D63,284 | S | 11/1923 | Challis |
| 1,505,296 | A | 8/1924 | Smith |
| 1,559,299 | A | 10/1925 | Barach |
| 1,574,213 | A | 2/1926 | Tyler |
| 1,575,364 | A | 3/1926 | Hodgkins |
| 1,582,836 | A | 4/1926 | Link |
| 1,594,850 | A | 8/1926 | Perkins |
| 1,623,523 | A | 4/1927 | Bourke |
| 1,650,183 | A | 11/1927 | Brooks |
| 1,658,581 | A | 2/1928 | Tobia |
| 1,841,062 | A | 1/1932 | Schavoir |
| 1,890,538 | A | 12/1932 | Hadden |
| 1,895,417 | A | 1/1933 | Lard |
| 1,946,134 | A | 2/1934 | Dyce |
| 1,968,092 | A | 7/1934 | Oldham |
| 2,020,679 | A | 11/1935 | Fitzpatrick |
| 2,171,383 | A | 8/1939 | Wettlaufer |
| 2,203,893 | A | 6/1940 | Chapman |
| 2,219,670 | A | 10/1940 | Wettlaufer |
| 2,225,931 | A | 12/1940 | Sexton |
| 2,464,850 | A | 3/1949 | Crawshaw |
| 2,705,147 | A | 3/1955 | Winter |
| 2,754,785 | A | 7/1956 | Zatko |

(Continued)

FOREIGN PATENT DOCUMENTS

| | | |
|---|---|---|
| WO | WO2004009186 | 1/2004 |

(Continued)

*Primary Examiner* — Sebastiano Passaniti
(74) *Attorney, Agent, or Firm* — Michael A. Catania

(57) ABSTRACT

A wood-type golf club head with an adjustable keel zone member is disclosed herein. The golf club head includes a body and an adjustable keel zone member. The body has a front portion, a crown portion and a sole portion. The body also having a heel end, a toe end and an aft end. The sole portion has only a single keel point. The adjustable keel zone member is disposed within a keel zone of the sole and located preferentially with respect to the center of gravity. The keel zone member is capable of adjusting the face angle of the wood-type golf club head.

21 Claims, 13 Drawing Sheets

U.S. PATENT DOCUMENTS

| | | | |
|---|---|---|---|
| 3,066,631 | A | 12/1962 | Geary |
| 3,191,936 | A | 6/1965 | Guier |
| 3,212,783 | A | 10/1965 | Bradley |
| 3,266,805 | A | 8/1966 | Bulla |
| 3,424,459 | A | 1/1969 | Evancho |
| 3,519,271 | A | 7/1970 | Smith |
| 3,524,646 | A | 8/1970 | Wheeler |
| 3,640,534 | A | 2/1972 | Mills |
| 3,810,621 | A | 5/1974 | Mills |
| 3,815,921 | A | 6/1974 | Turner |
| 3,819,181 | A | 6/1974 | Mills |
| 3,829,092 | A | 8/1974 | Arkin |
| 3,840,231 | A | 10/1974 | Moore |
| 3,848,737 | A | 11/1974 | Kenon |
| 3,891,212 | A | 6/1975 | Hill |
| 3,893,670 | A | 7/1975 | Franchi |
| 3,941,390 | A | 3/1976 | Hussey |
| 3,985,363 | A | 10/1976 | Jepson |
| 3,997,170 | A | 12/1976 | Goldberg |
| 4,021,047 | A | 5/1977 | Mader |
| 4,023,802 | A | 5/1977 | Jepson |
| 4,026,561 | A | 5/1977 | Baldorossi |
| 4,065,133 | A | 12/1977 | Gordos |
| 4,121,832 | A | 10/1978 | Ebbing |
| 4,141,559 | A | 2/1979 | Melvin |
| 4,214,754 | A | 7/1980 | Zebelean |
| 4,253,666 | A | 3/1981 | Murphy |
| 4,306,721 | A | 12/1981 | Doyle |
| 4,313,607 | A | 2/1982 | Thompson |
| 4,314,863 | A | 2/1982 | McCormick |
| 4,332,388 | A | 6/1982 | Crow |
| 4,340,227 | A | 7/1982 | Dopkowski |
| 4,429,879 | A | 2/1984 | Schmidt |
| 4,432,549 | A | 2/1984 | Zebelean |
| 4,438,931 | A | 3/1984 | Motomiya |
| 4,444,392 | A | 4/1984 | Duclos |
| 4,489,945 | A | 12/1984 | Kobayashi |
| 4,496,153 | A | 1/1985 | Kochevar |
| 4,502,687 | A | 3/1985 | Kochevar |
| 4,506,888 | A | 3/1985 | Nardozzi, Jr. |
| 4,511,145 | A | 4/1985 | Schmidt |
| 4,511,147 | A | 4/1985 | Olsen |
| 4,516,778 | A | 5/1985 | Cleveland |
| 4,545,580 | A | 10/1985 | Tomita et al. |
| 4,575,447 | A | 3/1986 | Hariguchi |
| 4,602,787 | A | 7/1986 | Sugioka |
| 4,624,460 | A | 11/1986 | Murase et al. |
| 4,630,827 | A | 12/1986 | Yoneyama |
| 4,632,400 | A | 12/1986 | Boone |
| 4,664,382 | A | 5/1987 | Palmer et al. |
| 4,667,963 | A | 5/1987 | Yoneyama |
| 4,681,321 | A | 7/1987 | Chen |
| 4,681,323 | A | 7/1987 | Alaki |
| 4,699,383 | A | 10/1987 | Kobayashi |
| 4,749,197 | A | 6/1988 | Orlowski |
| 4,762,322 | A | 8/1988 | Molitor et al. |
| 4,778,722 | A | 10/1988 | Yamamura et al. |
| 4,793,616 | A | 12/1988 | Fernandez |
| 4,811,949 | A | 3/1989 | Kobayashi |
| 4,824,110 | A | 4/1989 | Kobayashi |
| 4,852,782 | A | 8/1989 | Wu et al. |
| 4,854,580 | A | 8/1989 | Kobayashi |
| 4,854,582 | A | 8/1989 | Yamada |
| 4,872,685 | A | 10/1989 | Sun |
| 4,874,171 | A | 10/1989 | Ezaki et al. |
| 4,876,876 | A | 10/1989 | Ishida et al. |
| 4,895,368 | A | 1/1990 | Geiger |
| 4,901,552 | A | 2/1990 | Ginty |
| 4,927,144 | A | 5/1990 | Stormon |
| 4,943,059 | A | 7/1990 | Morell |
| 4,948,132 | A | 8/1990 | Wharton |
| 5,000,454 | A | 3/1991 | Soda |
| 5,004,241 | A | 4/1991 | Antonious |
| 5,009,425 | A | 4/1991 | Okumoto et al. |
| 5,028,049 | A | 7/1991 | McKeighen |
| 5,039,098 | A | 8/1991 | Pelz |
| 5,042,806 | A | 8/1991 | Helmstetter |
| 5,056,705 | A | 10/1991 | Wakita et al. |
| 5,060,951 | A | 10/1991 | Allen |
| 5,067,715 | A | 11/1991 | Schmidt et al. |
| 5,089,067 | A | 2/1992 | Schumacher |
| 5,090,702 | A | 2/1992 | Viste |
| 5,092,599 | A | 3/1992 | Okumoto et al. |
| 5,094,383 | A | 3/1992 | Anderson |
| 5,133,553 | A | 7/1992 | Divnick |
| 5,149,091 | A | 9/1992 | Okumoto |
| 5,154,425 | A | 10/1992 | Niskanen et al. |
| 5,178,394 | A | 1/1993 | Tanampai |
| 5,190,290 | A | 3/1993 | Take |
| 5,213,329 | A | 5/1993 | Okumoto et al. |
| 5,221,086 | A | 6/1993 | Antonious |
| 5,228,694 | A | 7/1993 | Okumoto |
| 5,232,224 | A | 8/1993 | Zeider |
| 5,242,168 | A | 9/1993 | Aizawa |
| 5,244,211 | A | 9/1993 | Lukasiewicz |
| 5,255,914 | A | 10/1993 | Schroder |
| 5,255,918 | A | 10/1993 | Anderson |
| 5,262,118 | A | 11/1993 | Fukushima et al. |
| 5,275,408 | A | 1/1994 | Desbiolles et al. |
| 5,280,923 | A | 1/1994 | Lu |
| 5,282,624 | A | 2/1994 | Viste |
| 5,318,296 | A | 6/1994 | Adams et al. |
| 5,322,206 | A | 6/1994 | Harada |
| 5,332,223 | A | 7/1994 | Johnson |
| 5,346,217 | A | 9/1994 | Tsuchiya |
| 5,350,556 | A | 9/1994 | Abe |
| 5,351,958 | A | 10/1994 | Helmstetter |
| 5,377,986 | A | 1/1995 | Viollaz et al. |
| 5,419,556 | A | 5/1995 | Take |
| 5,429,365 | A | 7/1995 | McKeighton |
| 5,433,442 | A | 7/1995 | Walker |
| 5,435,551 | A | 7/1995 | Chen |
| 5,447,307 | A | 9/1995 | Antonious |
| 5,467,989 | A | 11/1995 | Good |
| 5,485,998 | A | 1/1996 | Kobayashi |
| 5,489,098 | A | 2/1996 | Gojny et al. |
| 5,501,459 | A | 3/1996 | Endo |
| 5,509,660 | A | 4/1996 | Elmer |
| 5,513,844 | A | 5/1996 | Ashcraft et al. |
| 5,533,725 | A | 7/1996 | Reynolds, Jr. |
| 5,533,728 | A | 7/1996 | Pehoski |
| 5,540,435 | A | 7/1996 | Kawasaki |
| 5,542,666 | A | 8/1996 | Chou |
| 5,547,427 | A | 8/1996 | Rigal et al. |
| 5,584,770 | A | 12/1996 | Jensen |
| 5,588,921 | A | 12/1996 | Parsick |
| 5,593,356 | A | 1/1997 | Takeda |
| 5,601,501 | A | 2/1997 | Kobayashi |
| 5,626,528 | A | 5/1997 | Toulon |
| 5,653,645 | A | 8/1997 | Baumann |
| 5,658,207 | A | 8/1997 | Aizawa et al. |
| 5,672,120 | A | 9/1997 | Ramirez |
| 5,674,133 | A | 10/1997 | Chang |
| 5,688,188 | A | 11/1997 | Chappell |
| 5,700,208 | A | 12/1997 | Nelms |
| 5,702,310 | A | 12/1997 | Wozny |
| 5,704,850 | A | 1/1998 | Shieh |
| 5,722,901 | A | 3/1998 | Barron et al. |
| 5,735,755 | A | 4/1998 | Kobayashi |
| 5,749,790 | A | 5/1998 | Van Alen, II et al. |
| 5,779,560 | A | 7/1998 | Buck |
| 5,807,186 | A * | 9/1998 | Chen ..... 473/248 |
| 5,839,973 | A | 11/1998 | Jackson |
| 5,851,155 | A | 12/1998 | Wood et al. |
| 5,863,260 | A | 1/1999 | Butler, Jr. et al. |
| 5,906,549 | A | 5/1999 | Kubica |
| 5,931,742 | A | 8/1999 | Nishimura et al. |
| 5,938,541 | A | 8/1999 | Allen et al. |
| 5,951,411 | A | 9/1999 | Wood et al. |
| 5,961,394 | A | 10/1999 | Minabe |
| 5,971,867 | A | 10/1999 | Galy |
| 5,985,197 | A | 11/1999 | Nelson et al. |
| 5,989,134 | A | 11/1999 | Antonious |
| 6,039,659 | A | 3/2000 | Hamm |
| 6,102,813 | A | 8/2000 | Dill |
| 6,110,055 | A | 8/2000 | Wilson |
| 6,120,384 | A | 9/2000 | Drake |

| | | | | |
|---|---|---|---|---|
| 6,123,627 | A | 9/2000 | Antonious | |
| 6,149,533 | A | 11/2000 | Finn | |
| 6,251,028 | B1 | 6/2001 | Jackson | |
| 6,270,425 | B1 | 8/2001 | Dyer | |
| 6,273,828 | B1 | 8/2001 | Wood et al. | |
| 6,287,214 | B1 | 9/2001 | Satoh | |
| 6,290,609 | B1 | 9/2001 | Takeda | |
| 6,325,728 | B1 * | 12/2001 | Helmstetter et al. | 473/328 |
| 6,332,847 | B2 | 12/2001 | Murphy et al. | |
| 6,332,848 | B1 | 12/2001 | Long et al. | |
| 6,352,483 | B1 | 3/2002 | Okoshi | |
| 6,368,230 | B1 | 4/2002 | Helmstetter et al. | |
| 6,371,865 | B1 | 4/2002 | Magliulo | |
| 6,371,866 | B1 | 4/2002 | Rivera | |
| 6,386,990 | B1 | 5/2002 | Reyes et al. | |
| 6,447,404 | B1 | 9/2002 | Wilbur | |
| 6,450,896 | B1 | 9/2002 | Chen | |
| 6,478,691 | B2 | 11/2002 | Okoshi | |
| 6,478,692 | B2 * | 11/2002 | Kosmatka | 473/342 |
| 6,514,154 | B1 | 2/2003 | Finn | |
| 6,547,673 | B2 | 4/2003 | Roark | |
| 6,569,029 | B1 * | 5/2003 | Hamburger | 473/238 |
| 6,575,843 | B2 | 6/2003 | McCabe | |
| 6,607,452 | B2 | 8/2003 | Helmstetter et al. | |
| 6,620,053 | B2 | 9/2003 | Tseng | |
| 6,634,957 | B2 | 10/2003 | Tseng | |
| 6,645,086 | B1 | 11/2003 | Chen | |
| 6,663,501 | B2 | 12/2003 | Chen | |
| 6,669,573 | B2 | 12/2003 | Wood et al. | |
| 6,746,341 | B1 | 6/2004 | Hamric, Jr. et al. | |
| 6,764,413 | B2 | 7/2004 | Ho | |
| 6,769,994 | B2 | 8/2004 | Boone | |
| 6,769,996 | B2 | 8/2004 | Tseng | |
| 6,780,121 | B2 * | 8/2004 | Herber | 473/242 |
| RE38,605 | E | 9/2004 | Kubica et al. | |
| 6,789,304 | B2 | 9/2004 | Kouno | |
| 6,849,002 | B2 | 2/2005 | Rice | |
| 6,857,969 | B2 | 2/2005 | Rice | |
| 6,875,129 | B2 | 4/2005 | Erickson et al. | |
| 6,890,269 | B2 | 5/2005 | Burrows | |
| 6,899,636 | B2 | 5/2005 | Finn | |
| 6,902,497 | B2 | 6/2005 | Deshmukh et al. | |
| 6,926,616 | B1 | 8/2005 | Kusumoto et al. | |
| 6,966,847 | B2 | 11/2005 | Lenhof et al. | |
| 6,994,636 | B2 | 2/2006 | Hocknell et al. | |
| 6,997,818 | B2 | 2/2006 | Kouno | |
| 7,014,569 | B1 | 3/2006 | Figgers | |
| 7,025,117 | B2 | 4/2006 | Kusumoto et al. | |
| 7,083,529 | B2 | 8/2006 | Cackett et al. | |
| 7,115,046 | B1 | 10/2006 | Evans | |
| 7,147,573 | B2 * | 12/2006 | DiMarco | 473/324 |
| 7,241,229 | B2 | 7/2007 | Poynor | |
| 7,281,985 | B2 | 10/2007 | Galloway | |
| 7,300,359 | B2 | 11/2007 | Hocknell et al. | |
| 7,326,126 | B2 | 2/2008 | Holt et al. | |
| 7,335,113 | B2 | 2/2008 | Hocknell et al. | |
| 7,344,449 | B2 | 3/2008 | Hocknell et al. | |
| 7,387,577 | B2 | 6/2008 | Murphy et al. | |
| 7,410,426 | B2 | 8/2008 | Willett et al. | |
| 7,427,239 | B2 | 9/2008 | Hocknell et al. | |
| 7,465,239 | B2 | 12/2008 | Hocknell et al. | |
| 7,476,160 | B2 | 1/2009 | Hocknell et al. | |
| D588,661 | S | 3/2009 | Lee | |
| D588,662 | S | 3/2009 | Lee | |
| D588,663 | S | 3/2009 | Lee | |
| D588,664 | S | 3/2009 | Lee | |
| 7,699,717 | B2 | 4/2010 | Morris et al. | |
| 7,704,155 | B2 * | 4/2010 | Bennett et al. | 473/245 |
| 7,846,041 | B2 | 12/2010 | Beach et al. | |
| 7,871,336 | B2 * | 1/2011 | Breier et al. | 473/244 |
| 2001/0007835 | A1 | 7/2001 | Baron | |
| 2002/0037773 | A1 | 3/2002 | Wood et al. | |
| 2003/0008723 | A1 | 1/2003 | Goodman | |
| 2003/0134690 | A1 | 7/2003 | Chen | |
| 2004/0018886 | A1 | 1/2004 | Burrows | |
| 2004/0018887 | A1 | 1/2004 | Burrows | |
| 2004/0063515 | A1 | 4/2004 | Boone | |
| 2005/0049067 | A1 | 3/2005 | Hsu | |
| 2005/0049072 | A1 | 3/2005 | Burrows | |
| 2005/0079923 | A1 | 4/2005 | Droppleman | |
| 2006/0063608 | A1 | 3/2006 | Mori et al. | |
| 2006/0100032 | A1 | 5/2006 | Imamoto et al. | |
| 2006/0287125 | A1 | 12/2006 | Hocknell et al. | |
| 2007/0099719 | A1 | 5/2007 | Halleck et al. | |
| 2007/0117645 | A1 | 5/2007 | Nakashima | |
| 2007/0254746 | A1 | 11/2007 | Poynor | |
| 2007/0265106 | A1 | 11/2007 | Burrows | |
| 2008/0058114 | A1 | 3/2008 | Hocknell et al. | |
| 2008/0076590 | A1 | 3/2008 | Hsu | |
| 2008/0119301 | A1 | 5/2008 | Holt et al. | |
| 2008/0254908 | A1 | 10/2008 | Bennett et al. | |
| 2008/0280693 | A1 | 11/2008 | Chai | |
| 2009/0011848 | A1 | 1/2009 | Thomas et al. | |
| 2009/0011849 | A1 | 1/2009 | Thomas et al. | |
| 2009/0011850 | A1 | 1/2009 | Stites et al. | |
| 2009/0062029 | A1 | 3/2009 | Stites et al. | |
| 2009/0143167 | A1 | 6/2009 | Evans | |
| 2010/0292018 | A1 | 11/2010 | Cackett et al. | |

FOREIGN PATENT DOCUMENTS

| | | | |
|---|---|---|---|
| WO | WO2006/018929 | A1 * | 2/2006 |
| WO | WO2006055386 | | 5/2006 |

* cited by examiner

Open Face Angle

Neutral Face Angle

Closed Face Angle

Open Face Angle
Top Line = +2° Open Face Angle

Neutral Face Angle
Top Line = 0° Face Angle

Closed Face Angle
Top Line = -2° Closed Face Angle

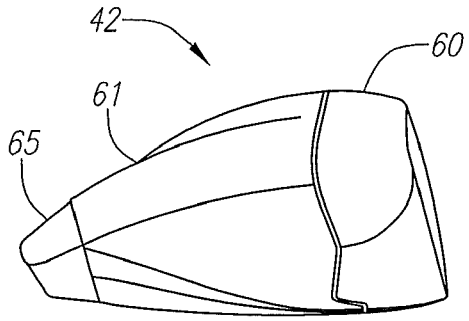
FIG. 29
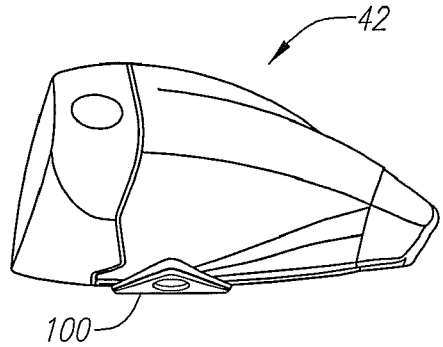
FIG. 30
FIG. 31
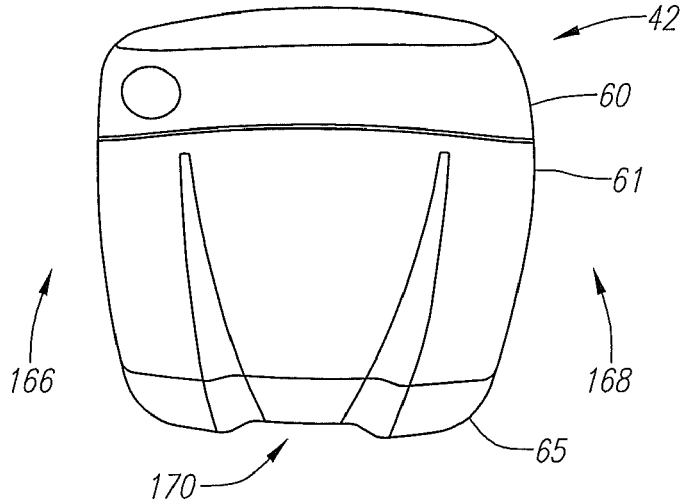
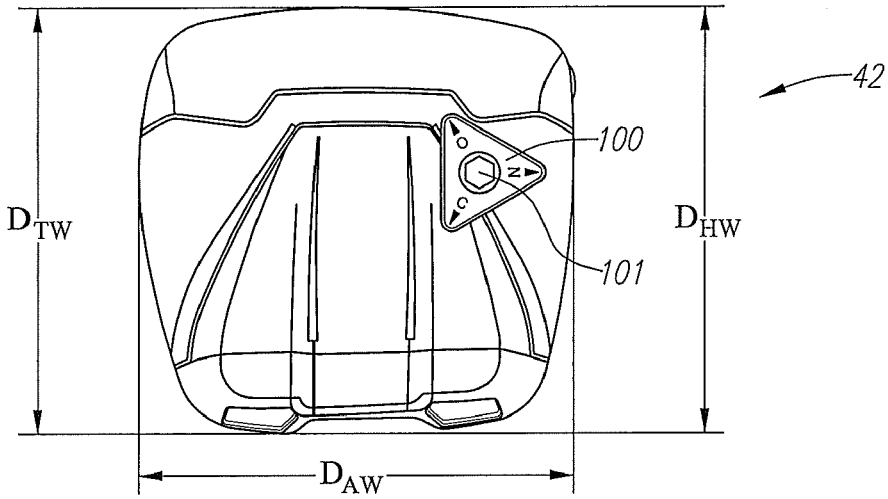
FIG. 32

WOOD-TYPE GOLF CLUB HEAD WITH ADJUSTABLE SOLE CONTOUR

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a wood-type golf club head with an adjustable sole contour.

2. Description of the Related Art

The prior art discloses golf clubs with means for adjusting the face angle. The face angle of a golf club is defined as the angle of the face to the grounded sole line with the shaft hole perpendicular to the line of flight. Maltby, *Golf Club Design, Fitting, Alteration, & Repair, The Principles & Procedures,* 4$^{th}$ Edition, Ralph Maltby Enterprises, (1995).

The perceived face angle is different than the measured face angle as would be measured on a device such as a CMM or De La Cruz gage. The measured face angle is based on the orientation of the face normal vector at a point in the center of the face. The perceived face angle is generally influenced by factors such as head outline shape at address and paint edge along the top of the face.

Alternative solutions to overcome the problem of variability of face angle at address include use of a dual keel point or multi-keel point sole shape, however these sole shapes have undesired affects on styling and on sound from striking the ball. Other inventions that allow for adjustments in the lie angle and face angle are also available. One such example is U.S. Pat. No. 7,281,985 for a Golf Club Head. The patent describes a golf club head which allows for the face angle, lie angle, loft angle, and shaft diameter of the golf club to be customized to a golfer. The customization of the face angle is accomplished by providing a golf club head with an insert for orientation of the golf club face angle following the manufacture of the golf club head.

A further example is U.S. Pat. No. 6,475,100 for a Golf Club Head With Adjustable Face Angle. The patent discloses a club head with an internal hosel and an insert disposed within that internal hosel. The insert allows for the face angle of the golf club to be oriented after manufacturing of the golf club head.

Yet a further example is U.S. Pat. No. 6,964,617 for a Golf Club Head With A Gasket. This patent discloses a golf club head with a gasket. The gasket controls the face angle of the club head. The width of the gasket varies to provide an open face angle club head, a closed face angle club head, or a neutral face angle club head.

Still another example is U.S. Pat. No. 7,377,862 for a Method For Fitting A Golf Club. The patent discloses a golf club head that has different hosel section orientations which allow for different face angles.

Woods, and in particular drivers, have historically been designed such that the sole shape (surface contour) is defined for styling or turf interaction purposes. Further, the center of gravity has been positioned in a location relative to the face in order to preferentially affect trajectory of the golf ball. The relationship between the sole shape and center of gravity of the golf club determines the face angle at address (natural sole) for a sole shape having a single contact point at equilibrium. This relationship has not been fully understood and as a result the face angle at address may often be different than intended in the design model. Some golfers are very sensitive to the look of an "open" or especially "closed" club face at address and this factor may weigh heavily in a purchase decision.

Whilst the club head design in CAD may orient the head in CAD space such that the face angle is at the desired value. This orientation is arbitrarily constrained and is not necessarily representative of the orientation when a player addresses the club and allows it to find an equilibrium orientation.

Further, the resulting face angle at address may vary significantly with lie angle at address. This is because the area on the sole that touches the ground ("keel" area) is dependent on sole shape in proximity to the ground at a given lie angle. Different players are known to have lie angles at address for woods that are as much as twenty degrees different. Some wood heads may overcome this limitation by use of a dual keel point or multi-keel point sole shape. Sole shapes of this type often have undesired affects on styling and on sound from striking a ball.

Other wood clubs may overcome this by use of an adjustable shaft having a "kick" in the shaft axis relative to the bore axis of the head. This allows the face angle at address to be adjusted as desired within a range of several degrees open or closed by rotating the shaft about the bore axis. The disadvantage of this method is that the loft of the club head is simultaneously affected when rotating the shaft in this manner. Thus while a preferred face angle may be obtained by this method, the resulting loft may be too strong or weak.

As a driver is rotated thru a range of address lie angles the measured face angle will generally change by an amount related to the loft of the face at initial orientation and the range of lie angles rotated thru. For instance, a driver having a 10 deg loft and 0 deg face angle (also known as "Square") at a design lie of 56 deg, will have a measured face angle that changes significantly (see FIG. 1) as address lie angle changes from 56 deg to 40 deg. This change in measured face angle is generally not perceived by the golfer as it doesn't result in rotation of the club head about a vertical axis. This behavior is widely considered desirable as it provides a consistent "looking" club at address for a wide range of players who may have different lie angles at address.

BRIEF SUMMARY OF THE INVENTION

The present invention seeks to overcome the variability and uncertainty of face angle at address (natural sole) for a wood having a single keel area (line or point). Further, this design seeks to provide the intended perceived face angle regardless of the lie angle at which the player addresses the club, within a range of 38-58 deg.

The perceived face angle is different than the measured face angle as would be measured on a device such as a CMM or De La Cruz gage. The measured face angle is based on the orientation of the face normal vector at a point in the center of the face. The perceived face angle is generally influenced by factors such as head outline shape at address and paint edge along the top of the face.

However, depending on the relative orientation of the club cg and the sole surface in the vicinity of contact with the ground, the measured and perceived face angles may vary unexpectedly at different address lie angles. This is a problem with many current woods which can result in problems with acceptance in the market place. Some golfers won't even try a club that has a face angle they consider unappealing, regardless of the performance of the club.

The sole surface within a defined proximity of the natural sole keel point ("keel zone") is such that even if the club is addressed at different lie angles (38-58 deg) the resulting perceived face angle will be constant within +/−0.5 deg.

The "line of equilibrium" is defined as a line that runs from a point on the underside of the grip at five inches below the butt end thru the club center of gravity and extending thru the head. The keel zone is defined relative to this line.

The invention is an adjustable keel member, defined as a local area on the sole of a club head wherein the sole contour can be manipulated for the purpose of changing face angle at address. The adjustable keel member has multiple differently tapered edges that can each be presented roughly parallel to the "X" axis by rotating the adjustable keel member. The taper of the edge roughly parallel to the X axis is designed to be the lowest (closest to the ground) portion of the sole and will determine the face angle by way it interacts with the ground plane. The edges of the adjustable keel member are sufficiently wide that the "equilibrium line" of the club CG will fall within the width of the edge, resulting in a stable grounding condition.

One aspect of the present invention is a wood-type golf club head. The golf club head includes a body and an adjustable keel zone member. The body has a front portion, a crown portion and a sole portion. The body also having a heel end, a toe end and an aft end. The sole portion has only a single keel point. The adjustable keel zone member is disposed within a keel zone of the sole and located preferentially with respect to the center of gravity. The keel zone member is capable of adjusting the face angle of the wood-type golf club head.

Preferably, the keel zone is located in the fore-aft direction relative to an equilibrium line. Preferably, the keel zone is located in the heel-toe direction by a target lie angle. Preferably, the center of the keel zone contacts the ground at the target lie angle and the zone is equally dispersed about the contact point in the heel and toe directions.

In a preferred embodiment, the adjustable keel zone member has a triangular shape with a first apex point, a second apex point and a third apex point. The first apex point and the second apex point each having a height greater than the height of the third apex point.

In a preferred embodiment, the adjustable keel zone member has a first edge between the first apex point and the second apex point, a second edge between the second apex point and the third apex point, and a third edge between the third apex point and the first apex point. The first edge has a constant height, the second edge has a height that decreases from the second apex point to the third apex point, and the third edge has a height that increases from the third apex point to the first apex point.

Preferably, the adjustable keel zone member has an aperture for placement of a bolt therethrough. Preferably, each of the first edge, the second edge and the third edge of the adjustable keel zone member has a length ranging from 0.5 inch to 1.5 inches. Preferably, each of the second edge and the third edge of the adjustable keel zone member has a three degrees inclination from apex point to apex point.

Another aspect of the present invention is wood-type golf club. The golf club includes a golf club head and shaft. The golf club head includes a body and an adjustable keel zone member. The body has a front portion, a crown portion and a sole portion. The body also having a heel end, a toe end and an aft end. The sole portion has only a single keel point. The adjustable keel zone member is disposed within a keel zone of the sole and located preferentially with respect to the center of gravity. The keel zone member is capable of adjusting the face angle of the wood-type golf club head. The shaft is connected to the golf club head.

Preferably, the golf club head has a volume ranging from 420 cc to 470 cc. Preferably, the center of the keel zone contacts the ground at the target lie angle and the zone is equally dispersed about the contact point in the heel and toe directions.

In a preferred embodiment, the sole of the golf club head has a keel zone flat area for placement of the adjustable keel zone member thereon. The keel zone flat area has a threaded aperture for receiving a threaded bolt for removably securing the adjustable keel zone member to the sole of the golf club head.

In a preferred embodiment, the adjustable keel zone member allows the wood-type type golf club to have an open face angle at address, a closed face angle at address or a neutral face angle at address. In a preferred embodiment, the adjustable keel zone member has a height ranging from 0.125 inch to 0.5 inch.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 29 is a toe side view of the club head of FIG. 26.

FIG. 30 is a heel side view of the club head of FIG. 26.

FIG. 31 is a top plan view of the club head of FIG. 26.

FIG. 32 is a bottom plan view of the club head of FIG. 26.

DETAILED DESCRIPTION OF THE INVENTION

Figure 1:
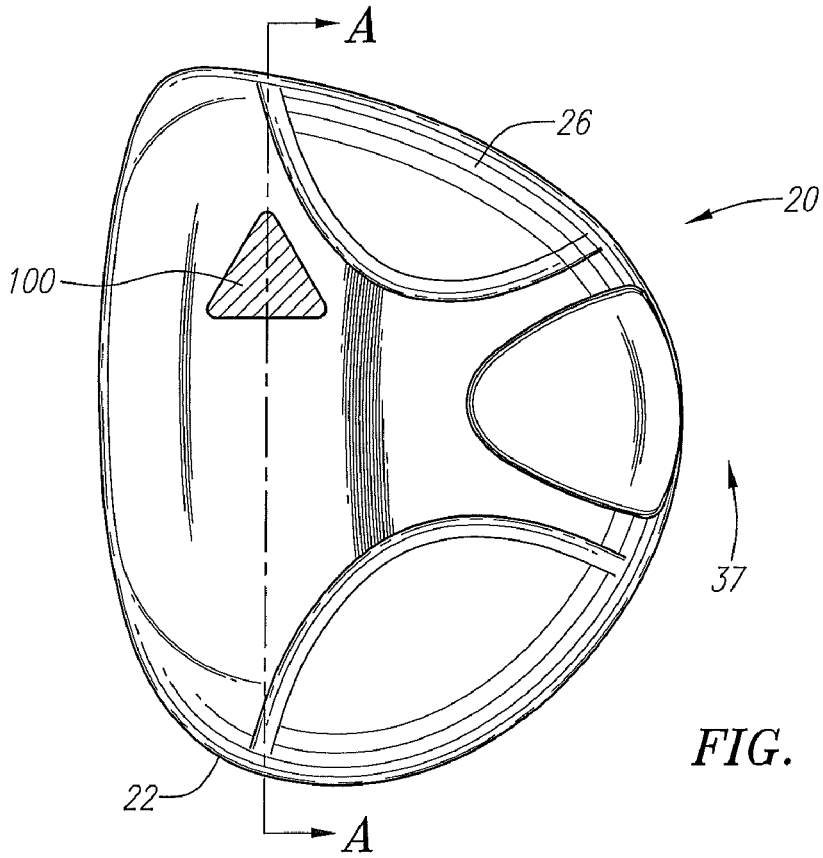
FIG. 1 is a bottom plan view of a golf club head.

As shown in FIGS. 1-7, a golf club head 20 has an adjustable keel zone member 100. The adjustable keel zone member 100 is positioned on a sole 26 of the golf club head 100. The golf club head 20 also preferably has a body 22 with a crown 24, a front wall 30 and the sole 26. The golf club head 20 also has a heel end 36, an aft end 37 and a toe end 38.

The golf club head 20 is preferably a multiple material golf club head such as disclosed in Foster et al., U.S. patent application Ser. No. 12/240,425, filed on Sep. 29, 2008, for a Golf Club Head, which is hereby incorporated by reference in its entirety. Alternatively, the golf club head 20 is a club head such as disclosed in Murphy et al., U.S. Pat. No. 7,383,577 for a Multiple Material Golf Club Head, which is hereby incorporated by reference. Alternatively, the golf club head 20 is a club head such as disclosed in Williams et al., U.S. Pat. No. 7,390,269 for a Golf Club Head, which is hereby incorporated by reference. Alternatively, the golf club head 20 is a club head such as disclosed in Gibbs et al., U.S. Pat. No. 7,448,960 for a Golf Club Head With Variable Face Thickness, which is hereby incorporated by reference. Alternatively, the golf club head 20 is a club head such as disclosed in Hocknell et al., U.S Pat. No. 7,413,520 for a Golf Club Head With High Moment OF Inertia, which is hereby incorporated by reference. Alternatively, the golf club head 20 is a club with an interchangeable shaft such as disclosed in Hocknell et al., U.S Pat. No. 7,427,239 for a Golf Club With Interchangeable Head-Shaft Connection, which is hereby incorporated by reference. Alternatively, the golf club head 20 is a club with an interchangeable shaft such as disclosed in Evans et al., U.S patent application Ser. No. 12/208,137, filed on Sep. 10, 2008, for a Golf Club With Removable Components, which is hereby incorporated by reference.

Figure 14:
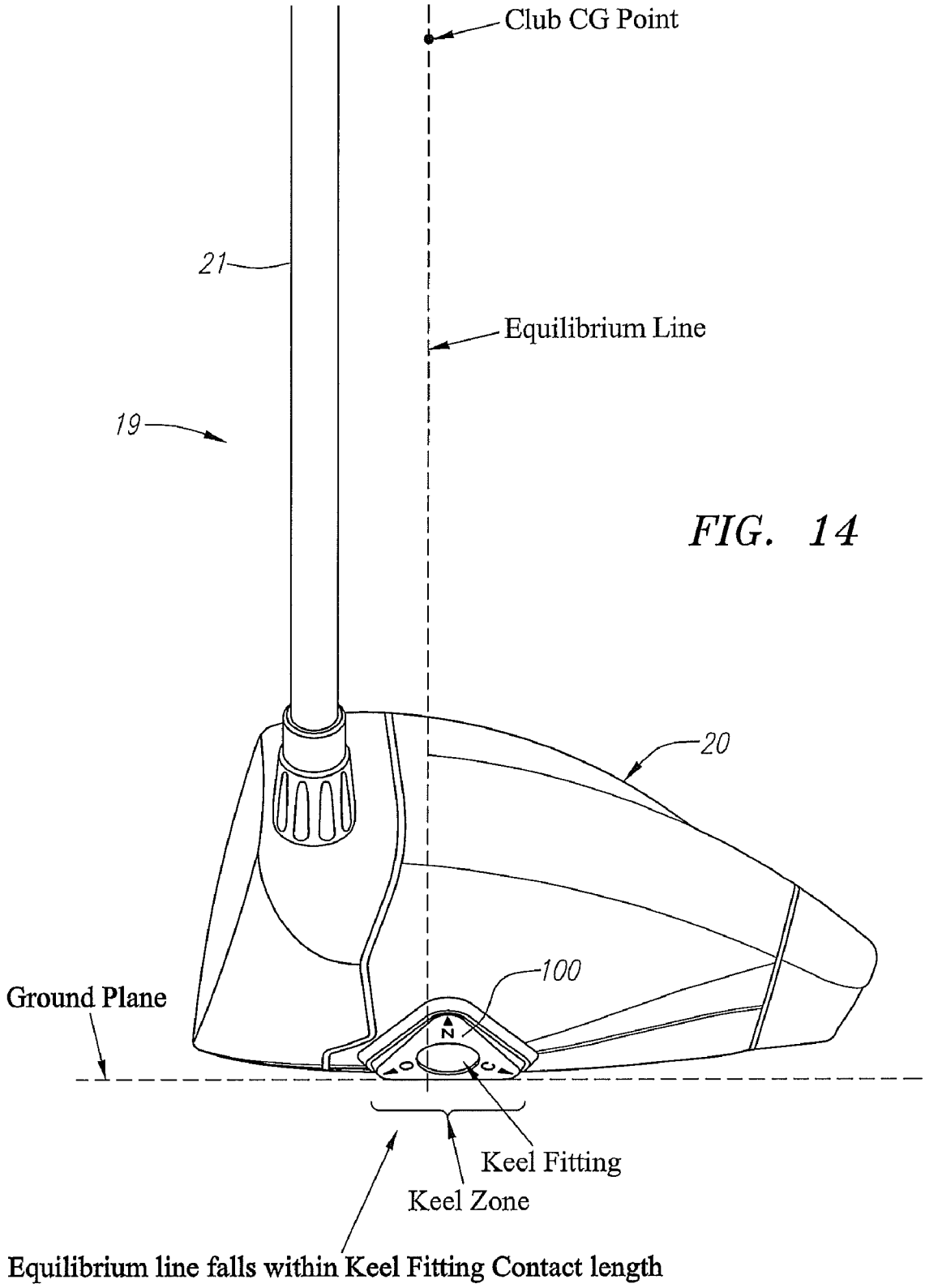
FIG. 14 is a side view of a golf club having an adjustable keel zone member.

The adjustable keel member 100 is preferably located in the fore-aft direction by the "equilibrium line" as shown in FIG. 14, which lies outside of shaft 21. The adjustable keel member 100 is preferably located in the heel-toe direction by the target lie angle as defined in FIG. 14. An edge of the adjustable keel member 100, oriented roughly parallel to the X axis contacts the ground at any lie angle within the desired range. The size of the adjustable keel member 100 is preferably a 1" by 1" square zone. The actual shape of the adjustable keel member 100 may be square, circular, triangular or other shape.

The invention describes an adjustable keel member 100 on the sole of a club head located preferentially with respect to the club Cg. Within this adjustable multi-edged surface the club head will contact the ground for any of a wide range of practical orientations (lie angles) at address. The adjustable keel member 100 can be rotated to cause one of several edges to engage the ground plane, thus preferentially modifying the face angle at address without affecting loft of the head at square impact.

The address lie angle may be very different for different golfers. As a result, if the design intent is for the club to appear to have the same face angle for all golfers it must be stable over a wide range of address lie angles.

Figure 9:
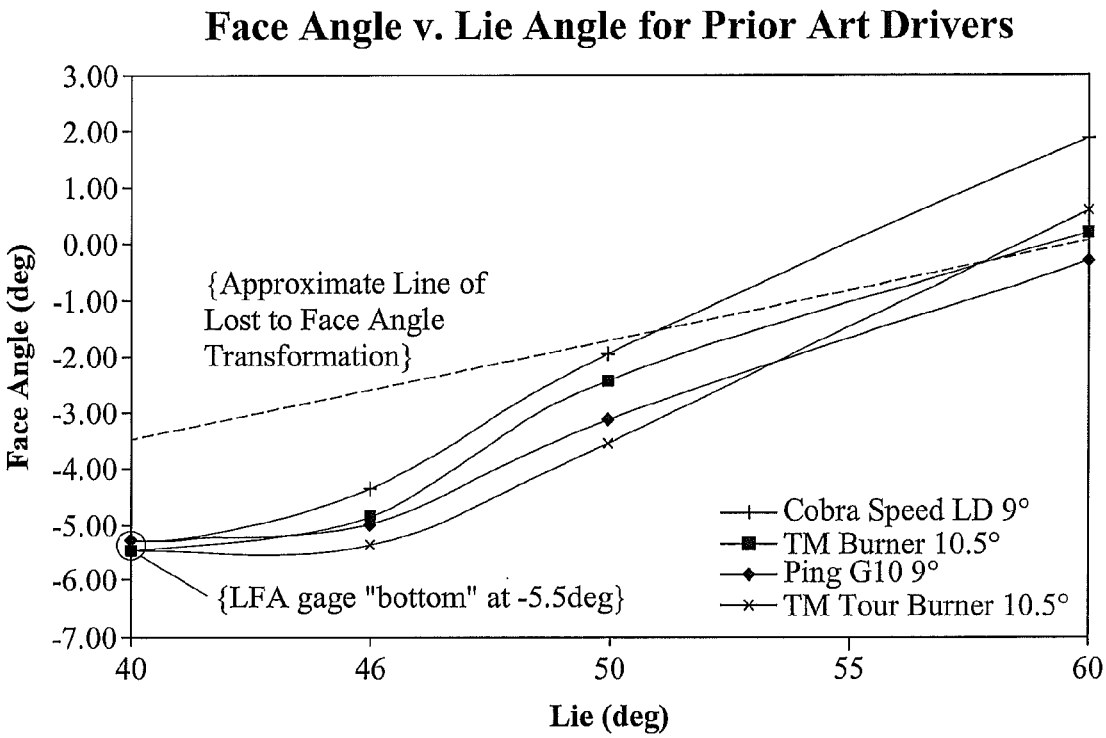
FIG. 9 is a graph showing measured face angles for various golf clubs at various lie angles ranging from 40 to 60 degrees.
Figure 10:
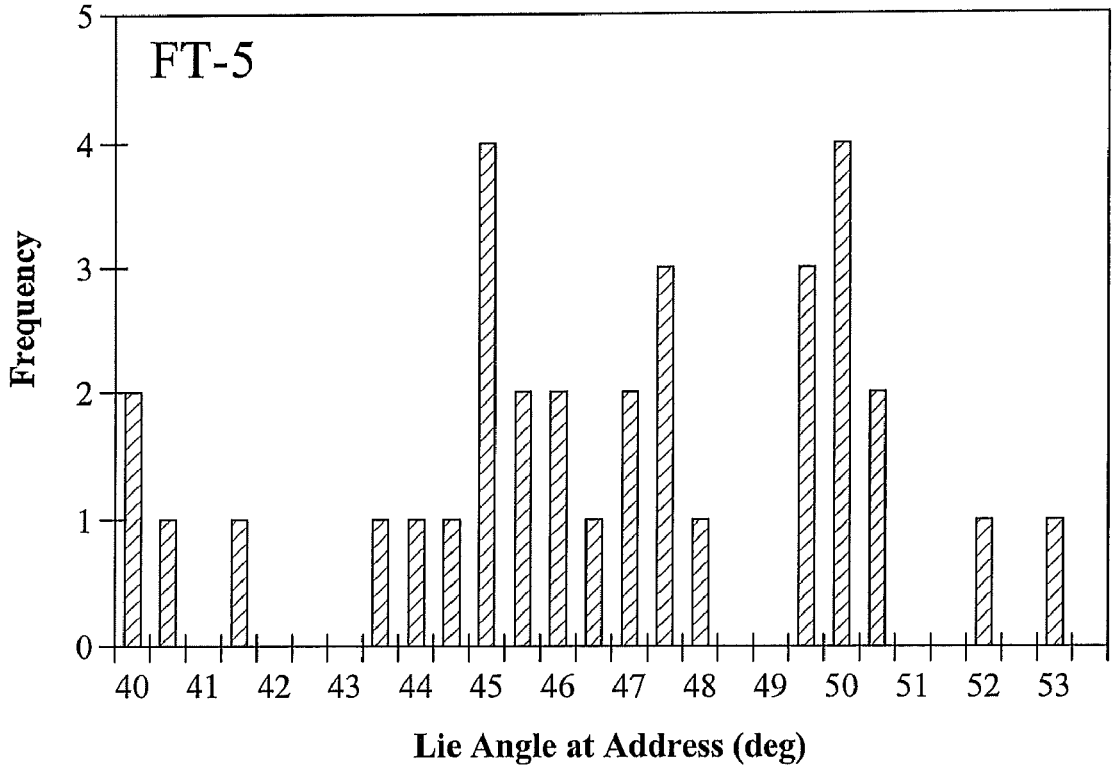
FIG. 10 is a chart illustrating the frequency distribution of lie angles at address for various golfers using the same standard driver having a golf club length of 46 inches.
Figure 11:
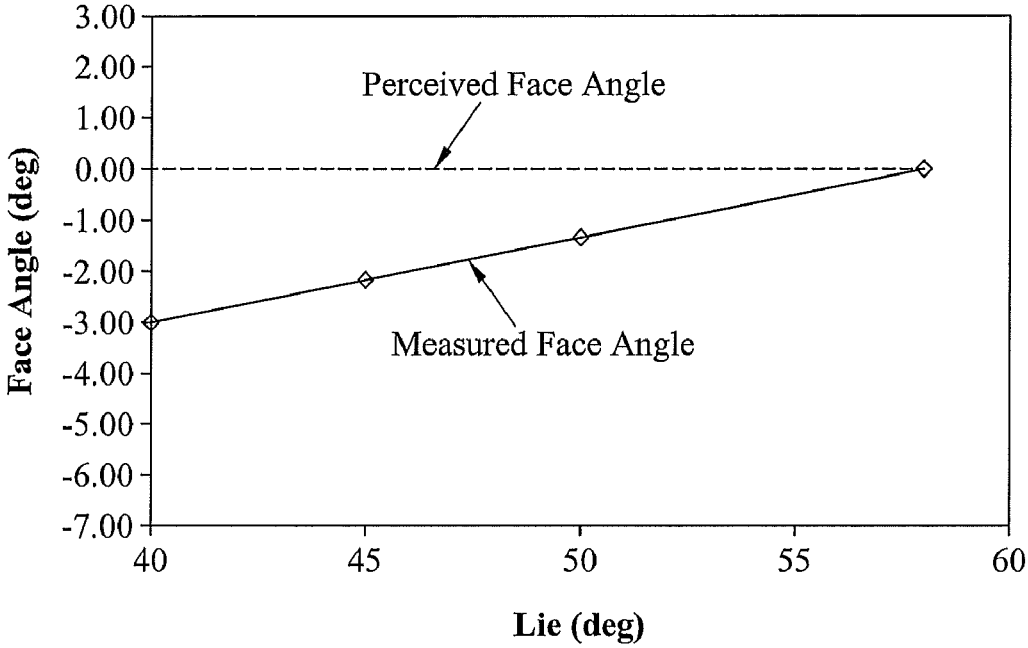
FIG. 11 is a graph showing ideal measured face angles and perceived face angles at various lie angles ranging from 40 to 60 degrees.
Figure 12:
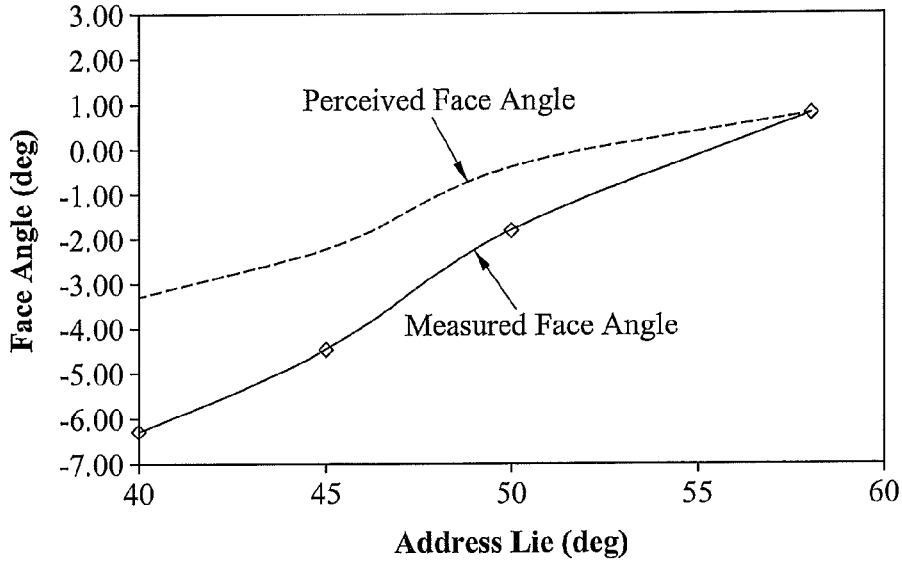
FIG. 12 is a graph showing actual measured face angles and perceived face angles at various lie angles ranging from 40 to 60 degrees.

As shown in FIG. 9, prior art drivers survey exhibit the undesirable behavior of excessive variation in face angle at different address lie angles as shown in FIG. 9.

The sole surface within a defined proximity of the natural sole keel point ("keel zone") is such that even if the club is addressed at different lie angles (40-60 deg) the resulting perceived face angle will be constant within +/−0.5 deg.

The "line of equilibrium" is defined as a line that runs from a point on the underside of the grip at 5" below the butt end thru the club center of gravity and extending thru the head. The keel zone is defined relative to this line.

The adjustable keel member 100 is positioned in a keel zone of the golf club, which is defined as a local prismatic surface on the sole of a club head. The keel zone surface is prismatic to the "X" axis which is oriented in the fore-aft (front-back) direction of the head at nominal design orientation. The keel zone is located in the fore-aft direction by the "equilibrium line" described in the previous section. The keel zone is located in the heel-toe direction by the target lie angle as defined in table 1. The center of the keel zone contacts the ground at the target lie angle and the zone is equally dispersed about the contact point in the heel and toe directions. The size of the keel zone is preferably 0.5" wide fore-aft and 1.0 inches wide heel-toe as measured when viewed from along the vertical axis. The keel zone surface is within 0.05" of this definition across the full extent of the surface.

Within this local prismatic surface the club head will contact the ground for any of a wide range of practical orientations (lie angles) at address. This causes the club to appear to have a stable face angle even when addressed at different lie angles.

An equilibrium line of a golf club 19 is show in FIG. 13, and runs from a point on the underside of the grip, preferably at 5 inches below the butt end through the club center of gravity and extending through the head. The sole surface, within a defined proximity of the sole keel point, is such that even if the club is addressed at different lie angles, between 40-60 degrees, the resulting perceived face angle will be constant within +/−0.5 degrees.

In one embodiment, the adjustable keel member 100 preferably has a width ranging from 0.50-0.60 inches in the fore-aft direction, centered on the equilibrium line and a width between 1.00-1.10 inches in the heel-toe direction located by the target lie angle. In this embodiment, the keel zone shape is prismatic to the surface of the sole, with a raised surface that is consistent in the heel-toe direction, and a surface that follows the contours of the club head in the front-aft direction.

The golf club head 20, when designed as a driver, preferably has a volume from 200 cubic centimeters to 600 cubic centimeters, more preferably from 300 cubic centimeters to 500 cubic centimeters, and most preferably from 350 cubic centimeters to 480 cubic centimeters. The volume of the golf club head 20 will also vary between fairway woods (preferably ranging from 3-woods to eleven woods) with smaller volumes than drivers. The golf club head 20 preferably has a mass no more than 225 grams, and most preferably a mass of 180 to 215 grams.

Preferably the golf club head 20 has a body 22 that is composed of titanium, titanium alloy, stainless steel or other iron-alloys. Alternatively, the body 22 may be composed of a lightweight metallic material, such as magnesium alloys, aluminum alloys, magnesium, aluminum or other low density metals.

Figure 13:
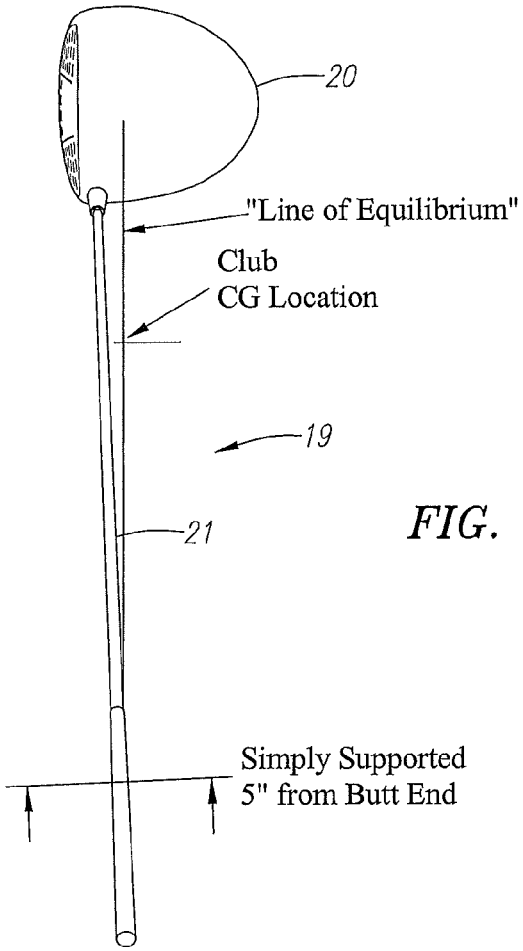
FIG. 13 is a top plan view of a golf club to illustrate the line of equilibrium.

FIG. 13 illustrates a golf club with a closed face angle. The golf club has a club head, a shaft with a grip attached at a butt end of the shaft. The keel zone makes the face angle of the golf club appear consistent at various lie angles.

Figure 15:
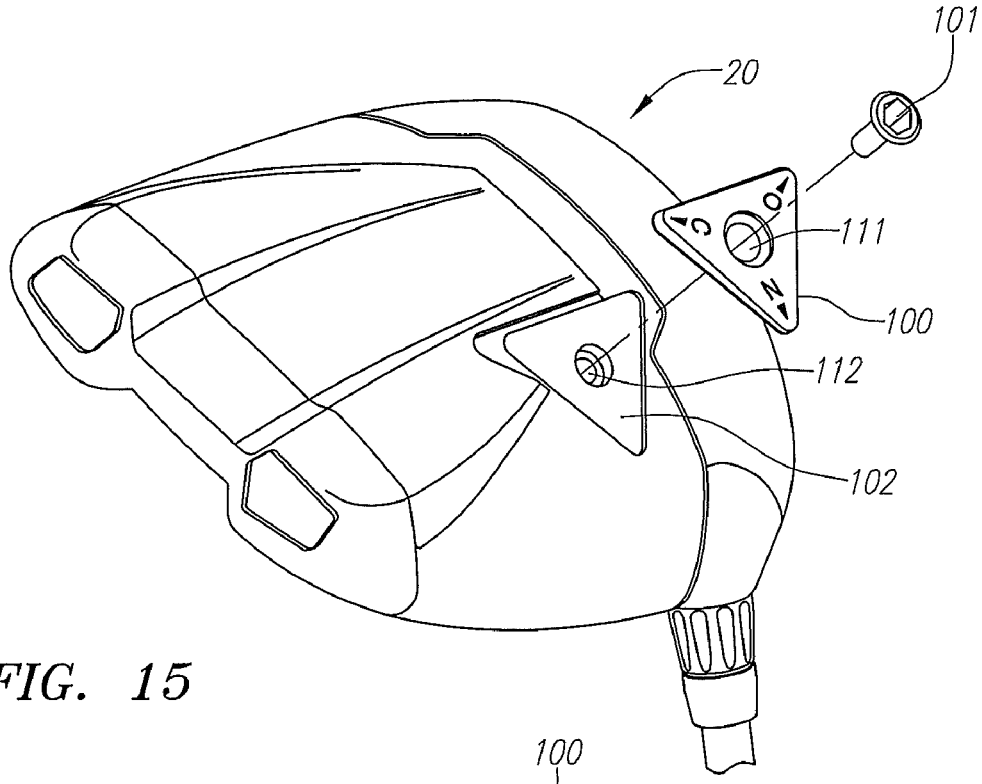
FIG. 15 is a bottom perspective view of a golf club with an exploded view of an adjustable keel zone member.

As shown in FIG. 15, the adjustable keel member 100 is positioned in a keel zone 102 of the golf club head 20, preferably using a threaded bolt 101 placed through an aperture 111 of the adjustable keel member 100 and secured in a threaded aperture 112 within the keel zone 102. The bolt 101 is removed for adjustment of the adjustable keel member 100 in order to adjust the face angle of the golf club 19.

Figure 16:
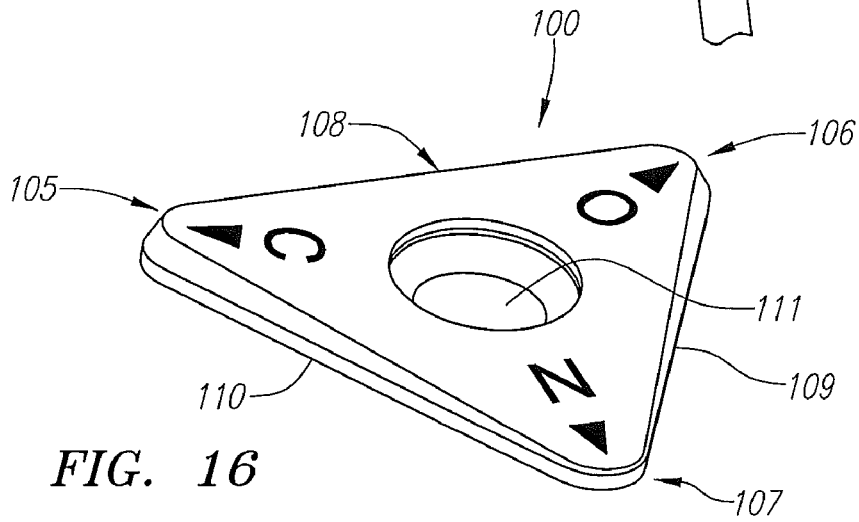
FIG. 16 is an isolated view of a preferred embodiment of an adjustable keel zone member.
Figure 17:
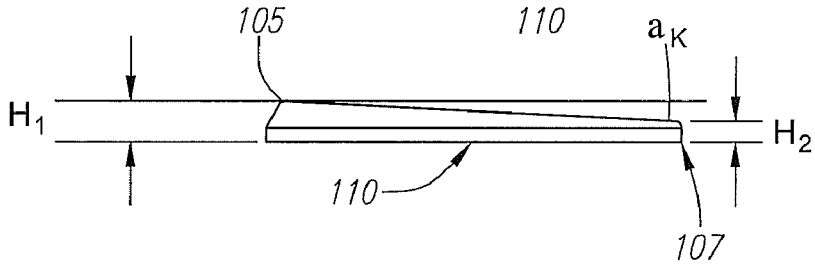
FIG. 17 is a side view of a preferred embodiment of an adjustable keel zone member.
Figure 18:
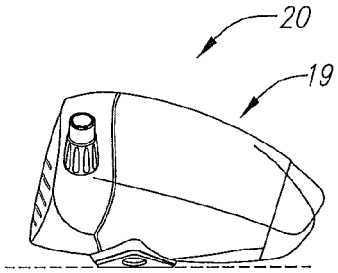
FIG. 18 is a side partial view of a golf club with an adjustable keel zone member in an open face angle orientation.
Figure 19:
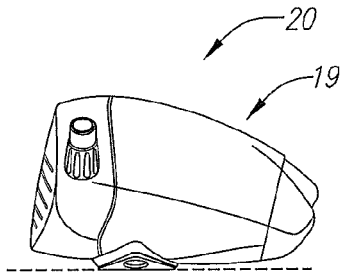
FIG. 19 is a side partial view of a golf club with an adjustable keel zone member in a neutral face angle orientation.
Figure 19A:
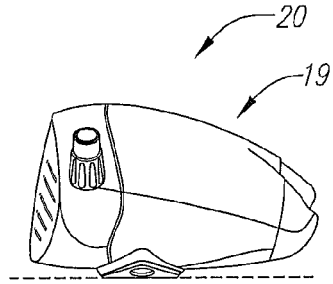
FIG. 19A is a side partial view of a golf club with an adjustable keel zone member in a closed face angle orientation.
Figure 20:
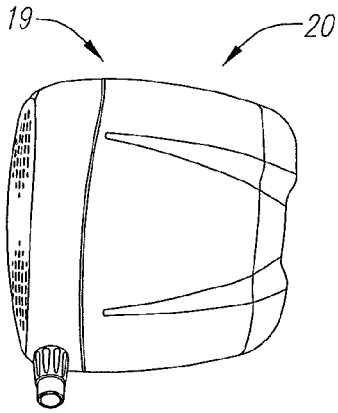
FIG. 20 is a top partial view of a golf club with an adjustable keel zone member in an open face angle orientation.
Figure 21:
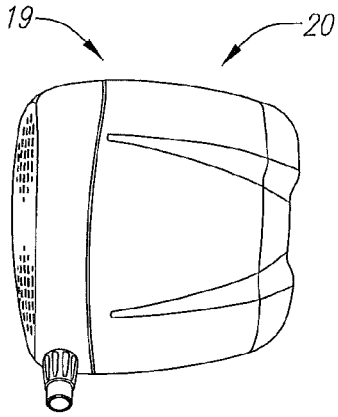
FIG. 21 is a top partial view of a golf club with an adjustable keel zone member in a neutral face angle orientation.
Figure 22:
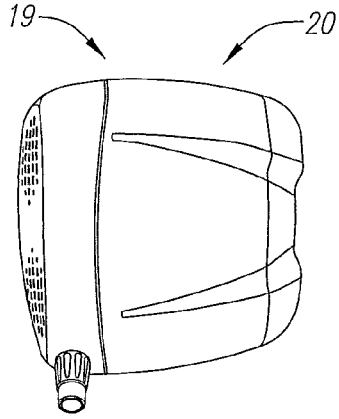
FIG. 22 is a top partial view of a golf club with an adjustable keel zone member in a closed face angle orientation.
Figure 23:
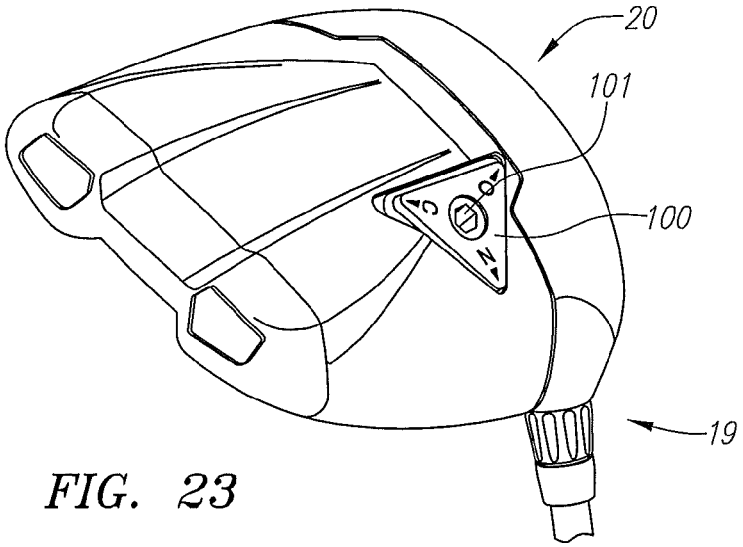
FIG. 23 is a bottom perspective view of a golf club with an adjustable keel zone member.
Figure 24:
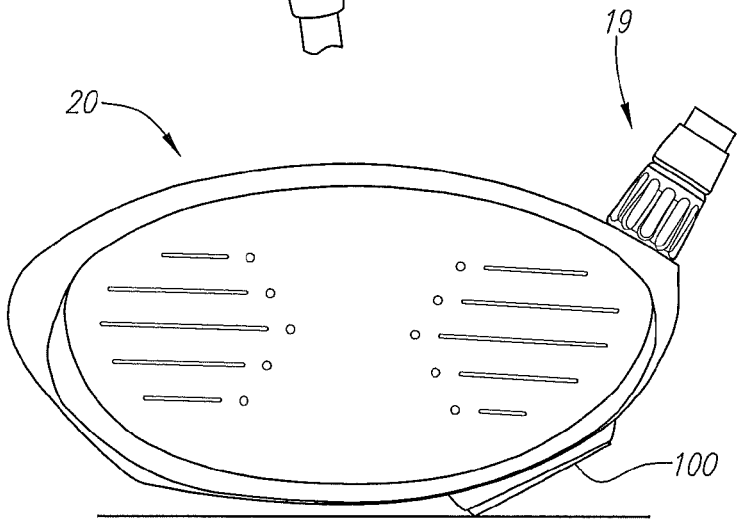
FIG. 24 is a front view of a golf club with an adjustable keel zone member.
Figure 25:
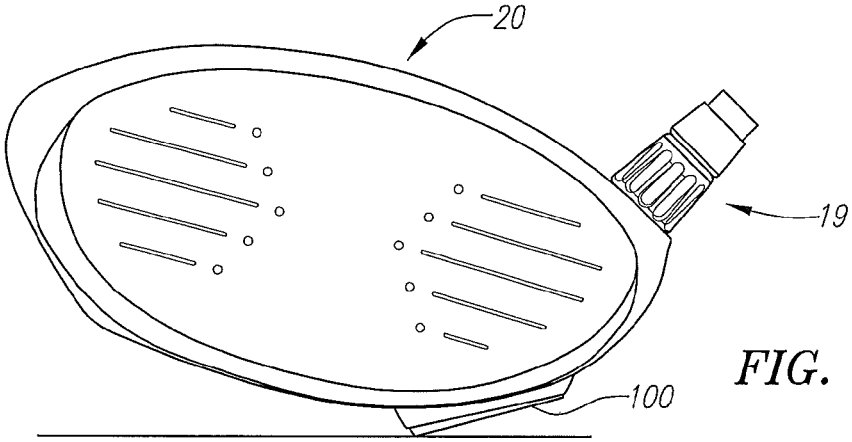
FIG. 25 is a front view of a golf club with an adjustable keel zone member in an address position.
Figure 26:
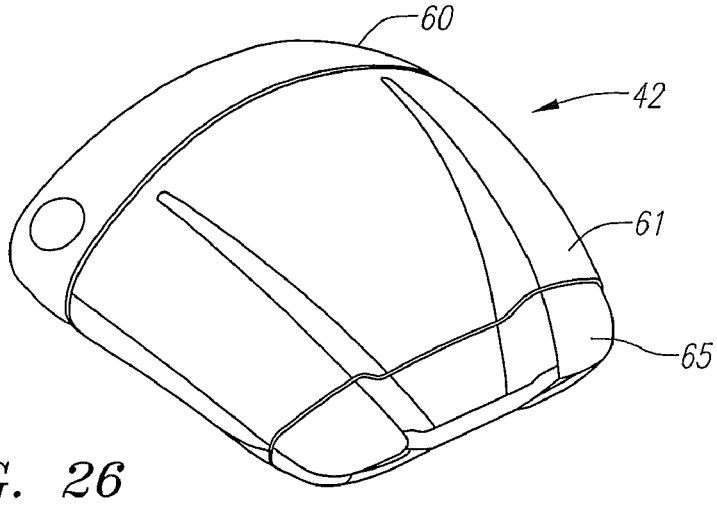
FIG. 26 is a rear perspective view of a golf club head.
Figure 27:
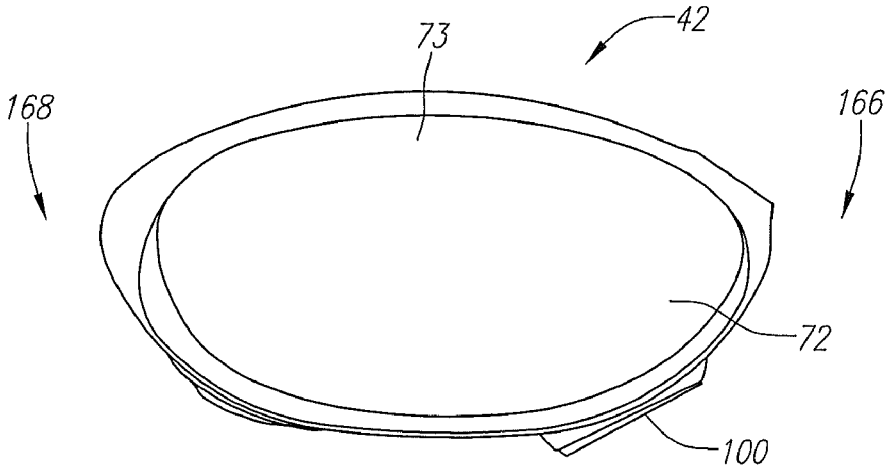
FIG. 27 is a front view of a golf club of the present invention.
Figure 28:
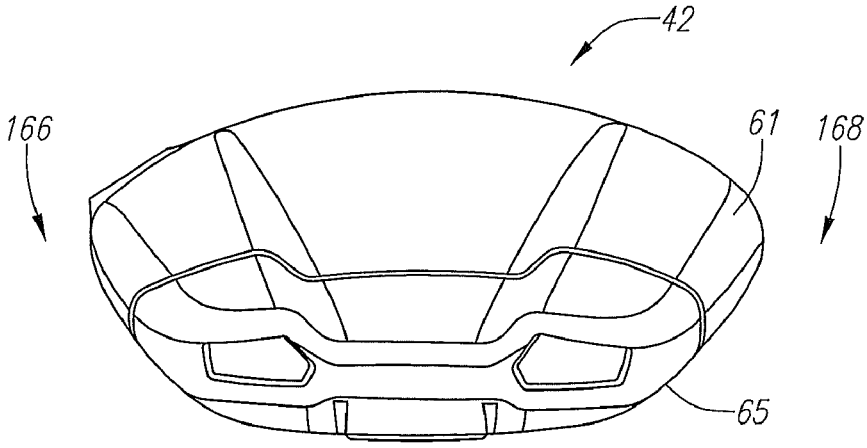
FIG. 28 is a rear view of the club head of FIG. 26.

As shown in FIG. 16, the adjustable keel member 100 is preferably triangular in shape with a first apex point 105, a second apex point 106 and a third apex point 107. A first edge 108 is between the first apex point 105 and the second apex point 106. A second edge 109 is between the second apex point 106 and the third apex point 107. A third edge 110 is between the first apex point 105 and the third apex point 107. In a preferred embodiment, the first edge 108 has a constant height. The second edge 109 has a height that decreases from the second apex point 106 to the third apex point 107. The third edge 110 has a height that decreases from the first apex point 105 to the third apex point 107. Preferably the third apex point 107 has a height H2 as shown in FIG. 17, which is lower than a height Hi for first and second apex points 105 and 106. Preferably the angle of inclination $\alpha K$ from the first or second apex points 105 and 106 to the third apex points 107 is three degrees. The adjustable keel member 100 is preferably composed of a metal material such as titanium alloy, aluminum alloy, stainless steel or a like material. FIGS. 18-22 show a golf club 19 with various face angles. FIG. 23 shows the adjustable keel member 100 is a neutral position. FIGS. 24 and 25 show a golf club 19 grounded and at address.

Figure 2:
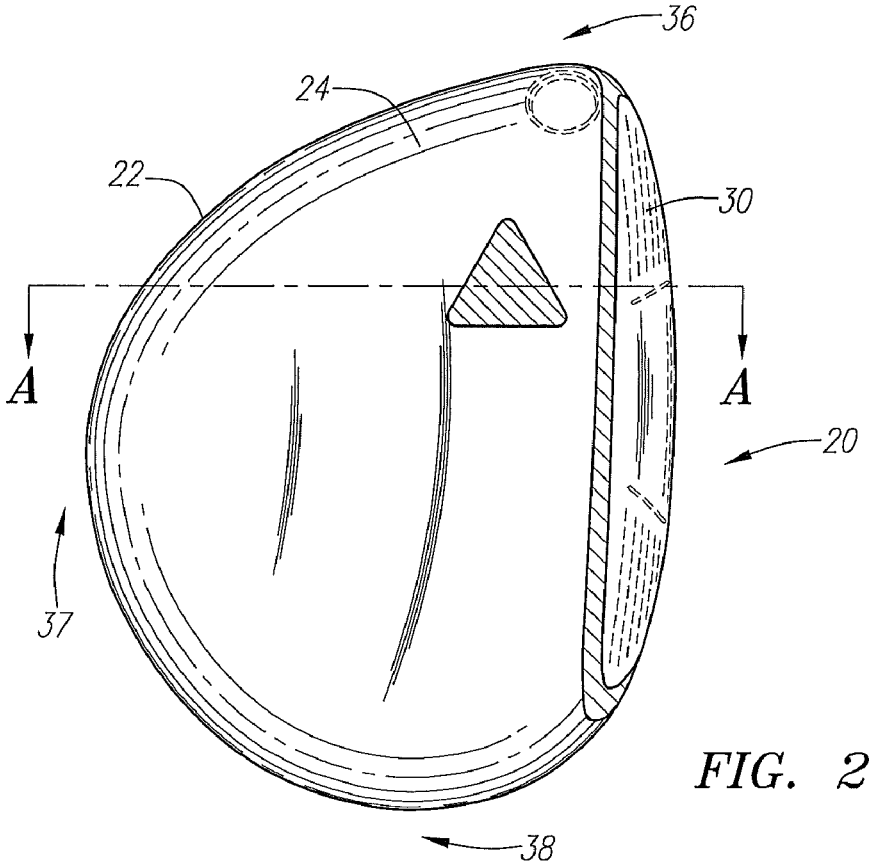
FIG. 2 is a top plan view of a golf club head.
Figure 1A:
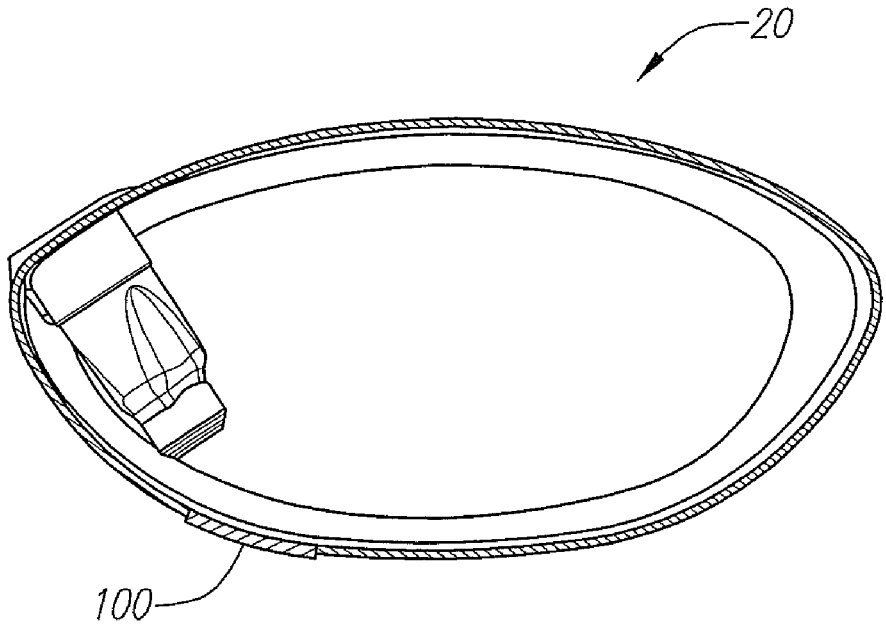
FIG. 1A is a cross-sectional view along line A-A of FIG. 1.
Figure 2A:
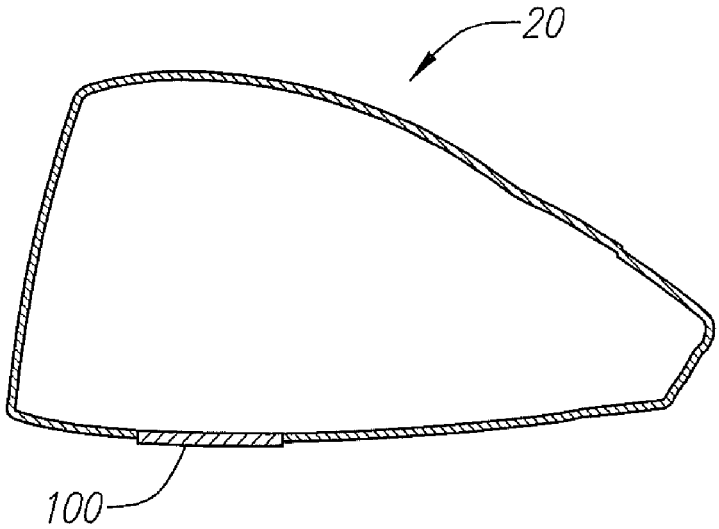
FIG. 2A is a cross-sectional view along line A-A of FIG. 2.
Figure 3:
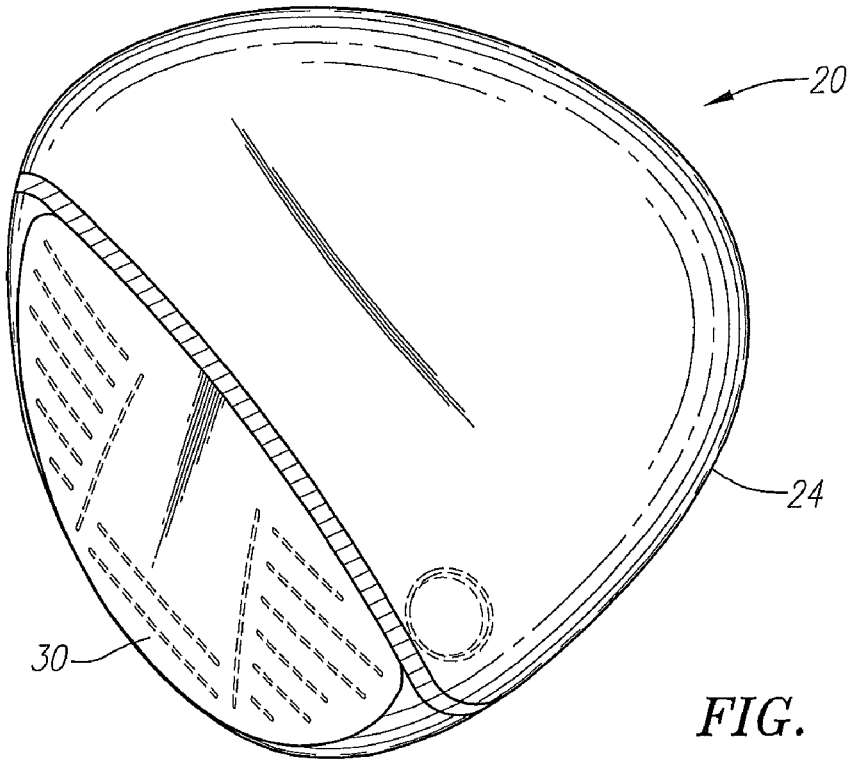
FIG. 3 is a top perspective view of a golf club head.
Figure 4:
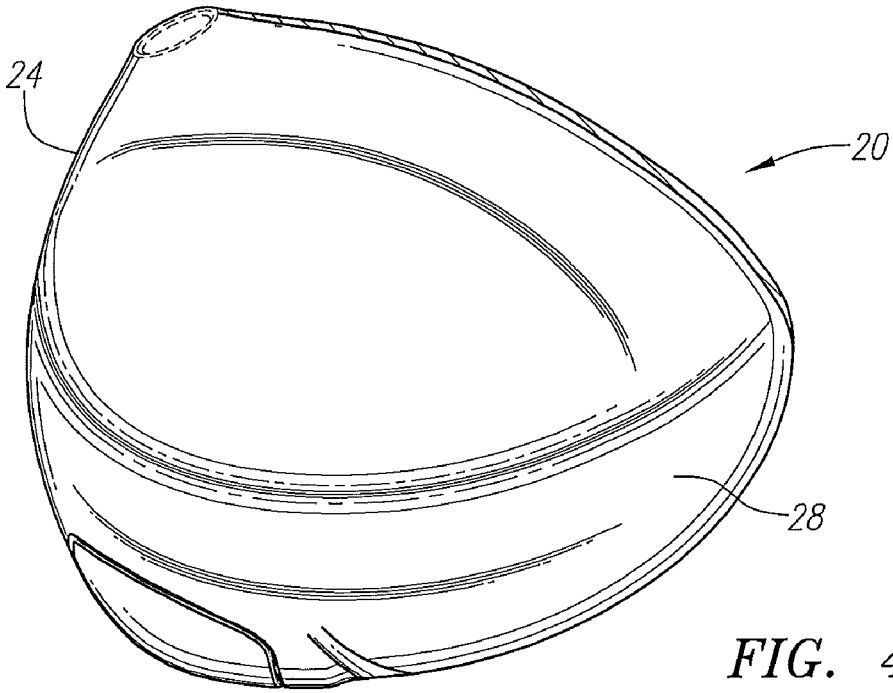
FIG. 4 is a rear view of a golf club head.
Figure 5:
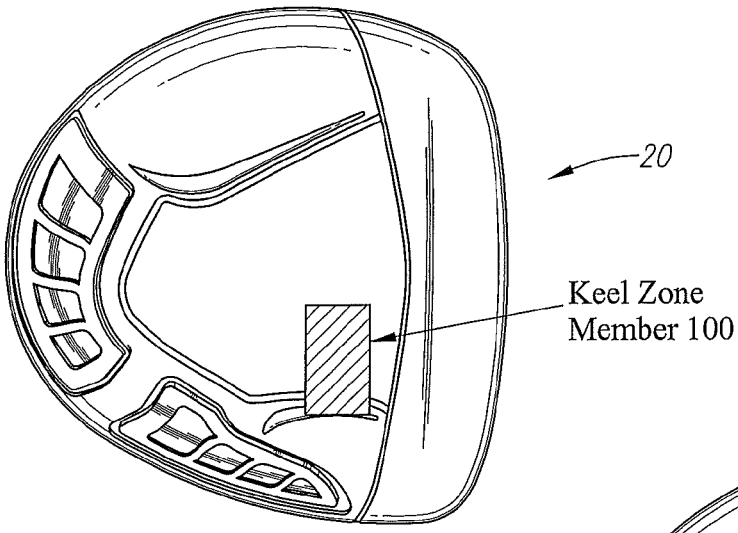
FIG. 5 is a bottom plan view of a golf club head illustrating a keel zone.
Figure 6:
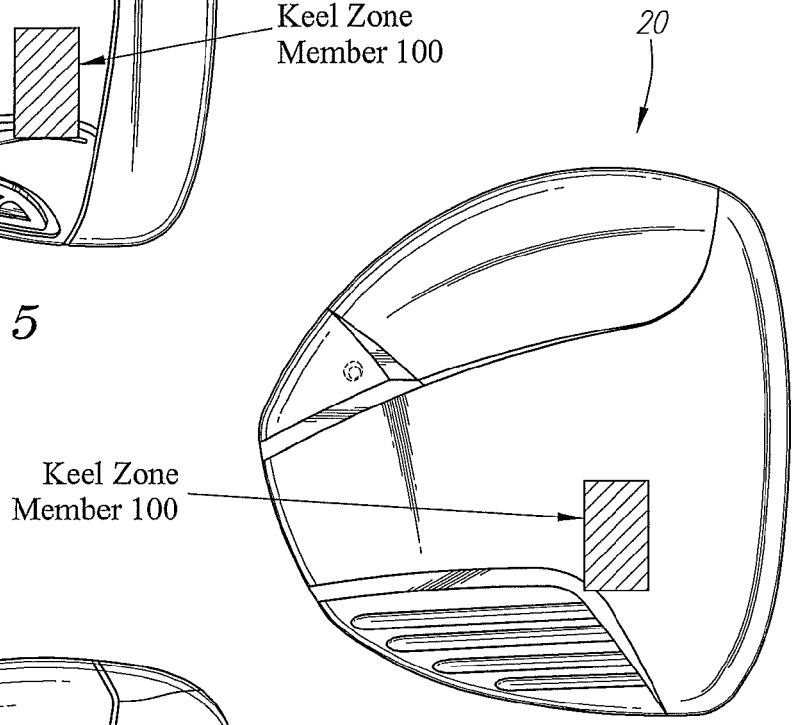
FIG. 6 is a bottom plan view of a golf club head illustrating a keel zone.
Figure 7:
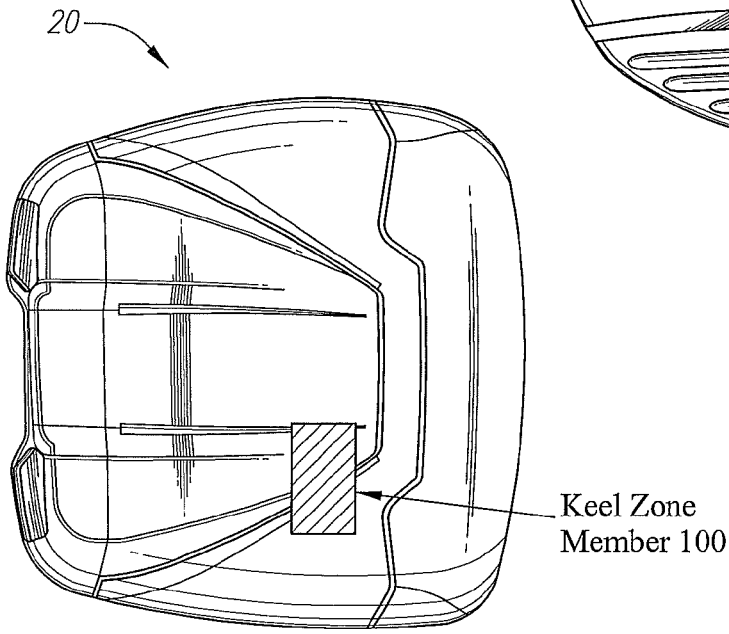
FIG. 7 is a bottom plan view of a golf club head illustrating a keel zone.
Figure 8:
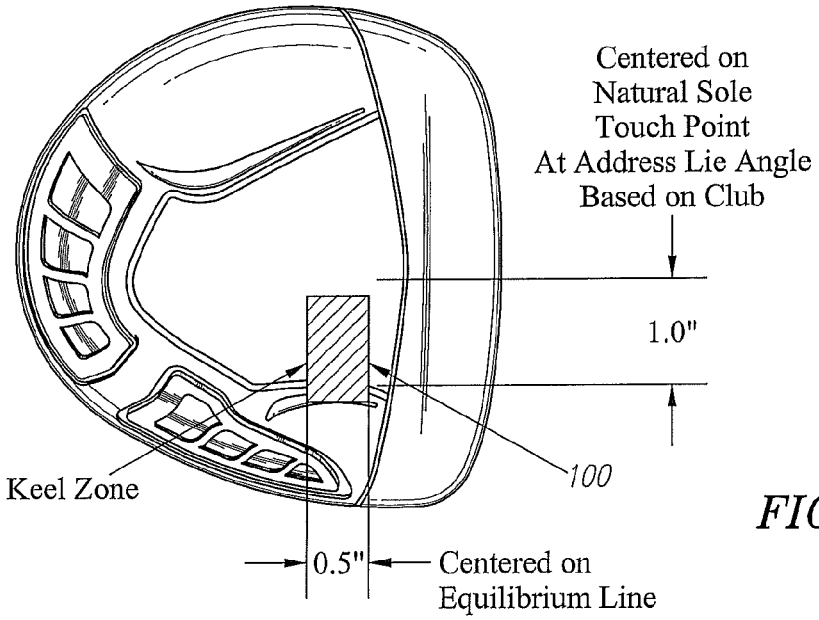
FIG. 8 is a bottom plan view of a golf club head illustrating a keel zone and providing a definition of the keel zone.

FIG. 1(*a*) illustrates a cross-sectional view of the golf club head 20 with the adjustable keel member 100. The adjustable keel member 100 has a raised surface that remains consistent in the heel-toe direction. FIG. 2(*a*) illustrates a cross sectional view of the golf club head 20 and adjustable keel member 100 in the fore-aft direction. The adjustable keel member 100 has a raised surface that mimics the surface contours of the sole shape.

In some embodiments, the heel end of the keel zone has a higher raised surface than the toe end. In other embodiments, the toe end of the alignment line has a higher raised surface than the heel end of the alignment line.

TABLE ONE

| | Club Length (Inches) | | | | | | | |
|---|---|---|---|---|---|---|---|---|
| | 40 | 41 | 42 | 43 | 44 | 45 | 46 | 47 |
| Address at lie (Degrees) | 51 | 50 | 49 | 48 | 47 | 46 | 45 | 44 |

An alternative embodiment is shown in FIGS. 26-32. A golf club head of the is generally designated 42. In a preferred embodiment, the club head 42 is generally composed of three components, a face component 60, a mid-body 61, and an aft-weight component 65. The mid-body 61 preferably has a crown section 62 and a sole section 64. The mid-body 61 optionally has a ribbon section 90.

The golf club head 42, when designed as a driver, preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. The volume of the golf club head 42 will also vary between fairway woods (preferably ranging from 3-woods to eleven woods) with smaller volumes than drivers.

The golf club head 42, when designed as a driver, preferably has a mass no more than 215 grams, and most preferably a mass of 180 to 215 grams. When the golf club head 42 is designed as a fairway wood, the golf club head preferably has a mass of 135 grams to 200 grams, and preferably from 140 grams to 165 grams.

The face component 60 is generally composed of a single piece of metal, and is preferably composed of a formed or forged metal material. More preferably, the metal material is a titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Alternatively, the face component 60 is manufactured through casting, machining, powdered metal forming, metal-injection-molding, electro chemical milling, and the like.

The face component 60 generally includes a striking plate (also referred to herein as a face plate) 72 and a return portion 74 extending laterally inward from a perimeter 73 of the striking plate 72. The striking plate 72 typically has a plurality of scorelines 75 thereon. The striking plate 72 preferably has a thickness ranging from 0.010 inch to 0.250 inch, and the return portion 74 preferably has a thickness ranging from 0.010 inch to 0.250 inch. The return portion 74 preferably extends a distance ranging from 0.25 inch to 1.5 inches from the perimeter 73 of the striking plate 72.

In a preferred embodiment, the return portion 74 generally includes an upper lateral section 76, a lower lateral section 78, a heel lateral section 80 and a toe lateral section 82. Thus, the return 74 preferably encircles the striking plate portion 72 a full 360 degrees. However, those skilled in the pertinent art will recognize that the return portion 74 may only encompass a partial section of the striking plate 72, such as 270 degrees or 180 degrees, and may also be discontinuous.

The upper lateral section 76 preferably extends inward, towards the mid-body 61, a predetermined distance to engage the crown section 62. In a preferred embodiment, the predetermined distance ranges from 0.2 inch to 1.2 inch, more preferably 0.40 inch to 1.0 inch, and most preferably 0.8 inch, as measured from the perimeter 73 of the striking plate 72 to the rearward edge of the upper lateral section 76. In a preferred embodiment, the upper lateral section 76 is substantially straight and substantially parallel to the striking plate 72 from the heel end 166 to the toe end 168.

The perimeter 73 of the striking plate 72 is preferably defined as the transition point where the face component 60 transitions from a plane substantially parallel to the striking plate portion 72 to a plane substantially perpendicular to the striking plate 72. Alternatively, one method for determining the transition point is to take a plane parallel to the striking plate 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking p1

The heel lateral section 80 is substantially perpendicular to the striking plate 72, and the heel lateral section 80 preferably covers a portion of a hosel 54 before engaging an optional ribbon section 90 and a bottom section 91 of the sole section 64 of the mid-body 61. The heel lateral section 80 is attached to the sole section 64, both the ribbon section 90 and the bottom section 91, as explained in greater detail below. The heel lateral section 80 extends inward a distance from the perimeter 73 a distance of 0.2 inch to 1.2 inch, more preferably 0.40 inch to 1.0 inch, and most preferably 0.8 inch. The heel lateral section 80 is preferably straight at its edge.

At the other end of the face component 60 is the toe lateral section 82. The toe lateral section 82 is preferably attached to the sole section 64, both the ribbon 90 and the bottom section 91, as explained in greater detail below. The toe lateral section 82 extends inward a distance from the perimeter 73 a distance of 0.2 inch to 1.2 inch, more preferably 0.40 inch to 1.0 inch, and most preferably 0.8 inch. The toe lateral section 82 preferably is preferably straight at its edge.

The lower lateral section 78 extends inward, toward the aft-body 61, a distance to engage the sole portion 64. In a preferred embodiment, the distance d ranges from 0.2 inch to 1.2 inch, more preferably 0.40 inch to 1.0 inch, and most preferably 0.8 inch, as measured from the perimeter 73 of the striking plate portion 72 to the edge of the lower lateral section 78.

The mid-body 61 is preferably composed of a non-metal material, preferably a composite material such as continuous fiber pre-preg material (including thermosetting materials or thermoplastic materials for the resin). Other materials for the mid-body 61 include other thermosetting materials or other thermoplastic materials such as injectable plastics. Alternatively, the mid-body 61 is composed of low-density metal materials, such as magnesium or aluminum. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The mid-body 61 is preferably manufactured through metal-injection-molding. Alternatively, the mid-body 61 is manufactured through casting, forming, machining, powdered metal forming, electro chemical milling, and the like.

The mid-body 61 is preferably manufactured through bladder-molding, resin transfer molding, resin infusion, injection molding, compression molding, or a similar process. In a preferred process, the face component 60, with an adhesive on the interior surface of the return portion 74, is placed within a mold with a preform of the mid-body 61 for bladder molding. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M Company. Alternatively, foam tapes such as Hysol Synspan may be utilized with the present invention.

A bladder is placed within the hollow interior of the preform and face component 60, and is pressurized within the mold, which is also subject to heating. The co-molding process secures the mid-body 61 to the face component 60. Alternatively, the mid-body 61 is bonded to the face component 60 using an adhesive, or mechanically secured to the return portion 74.

The crown portion 62 of the mid-body 61 engages the ribbon section 90 of sole section 64 outside of the engagement with the face component 60. The crown section 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole section 64, including the bottom section 91 and the optional ribbon section 90, which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. In a preferred embodiment, the mid-body 61 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety.

The hosel 54 is preferably at least partially disposed within the hollow interior of the club head 42, and is preferably located as a part of the face component 60. The hosel 54 is preferably composed of a similar material to the face component 60, and is preferably secured to the face component 60 through welding or the like. Alternatively, the hosel 54 may be formed with the formation of the face component 60.

The club head 42 preferably has a heel end 166, a toe end 168 and an aft-end 170 that are substantially straight. As shown in FIG. 32, the heel end 166 has a distance, "Dhw", from a furthest forward extent of the club head 42 to a furthest rearward extent of the club head 42 that preferably ranges from 2.00 to 5.00 inches, more preferably from 3.0 to 5.0 inches, and most preferably from 4.5 to 5.0 inches.

As shown in FIG. 32, the toe end 168 has a distance, "Dtw", from a furthest forward extent of the club head 42 to a furthest rearward extent of the club head 42 that preferably ranges from 2.00 to 5.00 inches, more preferably from 3.0 to 5.0 inches, and most preferably from 4.5 to 5.0 inches.

As shown in FIG. 32, the aft end 170 has a distance, "Daw", from a widest extent of the heel end 166 of the club head to a widest extent of the toe end 168 of the club head 42 that preferably ranges from 2.00 to 5.00 inches, more preferably from 3.0 to 5.0 inches, and most preferably from 4.5 to 5.0 inches. In one embodiment, the distances Dhw, Dtw and Daw are all equal in length ranging from 4.0 to 5.0 inches. In an alternative embodiment, the distances Dhw and Dtw are equal in length ranging from 4.5 to 5.0 inches.

In a preferred embodiment, the aft weight component 65 is preferably positioned on a rear inlaid portion 68 of the mid-body 61. The aft-weight component 65 generally includes two parts, a cap and a weight member. The weight member is preferably bonded to the cap using an adhesive material. The aft weight component 65 increases the moment of inertia of the club head 42, influences the center of gravity, and/or influences other inherent mass properties of the golf club head 42.

The cap is preferably composed of a light-weight material, most preferably aluminum or an aluminum alloy. The cap generally has a thickness ranging from 0.02 to 0.10 inch, and most preferably from 0.03 inch to 0.04 inch. The cap preferably has a mass ranging from 5 to 20 grams, and most preferably approximately 10 grams.

Individually, each weight member has a mass ranging from 5 grams to 30 grams. Each weight member is preferably composed of a material that has a density ranging from 5 grams per cubic centimeters to 20 grams per cubic centimeters, more preferably from 7 grams per cubic centimeters to 12 grams per cubic centimeters. The "dumbbell" like shape of the weight member allows for the mass of the aft-weight component to be focused for a fade golf drive, a neutral golf drive or a draw golf drive.

Each weight member is preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyester polyurethane. A preferred weight member is an injection molded thermoplastic polyurethane integrated with tungsten to have a density of 8.0 grams per cubic centimeters. In a preferred embodiment, each weight member is composed of from 50 to 95 volume percent polyurethane and from 50 to 5 volume percent tungsten. Also, in a preferred embodiment, each weight member is composed of from 10 to 25 weight percent polyurethane and from 90 to 75 weight percent tungsten.

Those skilled in the pertinent art will recognize that other weighting materials may be utilized for the aft weight component 65 without departing from the scope and spirit of the present invention. The placement of the aft weight component 65 allows for the moment of inertia of the golf club head 42 to be optimized.

Alternatively, the weight member is composed of tungsten loaded film, tungsten doped polymers, or similar weighting mechanisms such as described in U.S. Pat. No. 6,386,990, entitled A Composite Golf Club Head With An Integral Weight Strip, and hereby incorporated by reference in its entirety. Those skilled in the pertinent art will recognize that other high density materials, such as lead-free pewter, may be utilized as an optional weight without departing from the scope and spirit of the present invention.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A wood-type golf club head comprising:

a body having a front portion, a crown portion and a sole portion, the body also having a heel end, a toe end and an aft end, the sole portion having only a single keel point;

an adjustable keel zone member disposed within a keel zone of the sole portion, wherein rotation of the adjustable keel zone member adjusts the face angle of the wood-type golf club head, wherein the adjustable keel zone member has a triangular shape with a first apex point, a second apex point and a third apex point, the first apex point and the second apex point each having a height greater than the height of the third apex point.

2. The wood-type golf club head according to claim 1 wherein the keel zone is located in the heel-toe direction by a target lie angle.

3. The wood-type golf club head according to claim 1 wherein the center of the keel zone contacts the ground at the target lie angle and the zone is equally dispersed about the contact point in the heel and toe directions.

4. The wood-type golf club head according to claim 1 wherein the adjustable keel zone member has a first edge between the first apex point and the second apex point, a second edge between the second apex point and the third apex point, and a third edge between the third apex point and the first apex point, wherein the first edge has a constant height, the second edge has a height that decreases from the second apex point to the third apex point, and the third edge has a height that increases from the third apex point to the first apex point.

5. The wood-type golf club head according to claim 4 wherein each of the first edge, the second edge and the third edge of the adjustable keel zone member has a length ranging from 0.5 inch to 1.5 inches.

6. The wood-type golf club head according to claim 4 wherein each of the second edge and the third edge of the adjustable keel zone member has an angle of inclination of three degrees from apex point to apex point.

7. The wood-type golf club head according to claim 1 wherein the adjustable keel zone member has an aperture for placement of a bolt therethrough.

8. A wood-type golf club comprising:

a golf club head comprising a body having a front portion, a crown portion and a sole portion, the body also having a heel end, a toe end and an aft end, the sole portion having a single keel point, an adjustable keel zone member disposed within a keel zone of the sole portion, wherein rotation of the adjustable keel zone member adjusts the face angle of the wood-type golf club head, wherein the adjustable keel zone member has a triangular shape with a first apex point, a second apex point and a third apex point, the first apex point and the second apex point each having a height greater than the height of the third apex point; and a shaft connected to the golf club head;

wherein the keel zone is located in the fore-aft direction relative to an equilibrium line of the golf club and in the toe-heel direction relative to a target lie angle of the golf club.

9. The wood-type golf club according to claim 8 wherein the golf club head has a volume ranging from 420 cc to 470 cc.

10. The wood-type golf club according to claim 8 wherein the center of the keel zone contacts the ground at the target lie angle and the zone is equally dispersed about the contact point in the heel and toe directions.

11. The wood-type golf club according to claim 8 wherein the adjustable keel zone member has a first edge between the first apex point and the second apex point, a second edge between the second apex point and the third apex point, and a third edge between the third apex point and the first apex point, wherein the first edge has a constant height, the second edge has a height that decreases from the second apex point to the third apex point, and the third edge has a height that increases from the third apex point to the first apex point.

12. The wood-type golf club according to claim 11 wherein each of the first edge, the second edge and the third edge of the adjustable keel zone member has a length ranging from 0.5 inch to 1.5 inches.

13. The wood-type golf club according to claim 11 wherein each of the second edge and the third edge of the adjustable keel zone member has a three degrees inclination from apex point to apex point.

14. The wood-type golf club according to claim 8 wherein the adjustable keel zone member has an aperture for placement of a bolt therethrough.

15. The wood-type golf club according to claim 8 wherein the sole of the golf club head has a keel zone flat area for placement of the adjustable keel zone member thereon, the keel zone flat area having a threaded aperture for receiving a threaded bolt for removably securing the adjustable keel zone member to the sole of the golf club head.

16. The wood-type golf club according to claim 8 wherein the adjustable keel zone member allows the wood-type golf club to have an open face angle at address, a closed face angle at address or a neutral face angle at address.

17. The wood-type golf club according to claim 8 wherein the adjustable keel zone member has a height ranging from 0.125 inch to 0.5 inch.

18. A wood-type golf club head comprising:

a body having a front portion, a crown portion and a sole portion, the body also having a heel end, a toe end and an aft end, the body composed of a titanium alloy material, the body having a volume ranging from 420 cc to 470 cc; and an adjustable keel zone member disposed on the sole portion of the body, the adjustable keel zone member having a substantially triangular shape with a first edge, a second edge and a third edge, the first edge and the second edge each having a height greater than the height of the third edge, wherein rotation of the keel zone member adjusts the face angle of the wood-type golf club head.

19. The wood-type golf club head according to claim 18 wherein the adjustable keel zone member has an aperture for placement of a bolt therethrough, the wood-type golf club head further comprises a bolt for removeable placement in the aperture of the adjustable keel zone member.

20. A wood-type golf club comprising:

a golf club head comprising a body having a front portion, a crown portion and a sole portion, the body also having a heel end, a toe end and an aft end, the body composed of a titanium alloy material, the body having a volume ranging from 420 cc to 470 cc, an adjustable keel zone member disposed on the sole portion, the adjustable keel zone member having a substantially triangular shape with a first edge, a second edge and a third edge, the first edge and the second edge each having a height greater than the height of the third edge, wherein rotation of the adjustable keel zone member adjusts the face angle of the wood-type golf club head; and a shaft connected to the golf club head.

21. The wood-type golf club according to claim 20 wherein the adjustable keel zone member allows the wood-type golf club to have an open face angle at address, a closed face angle at address or a neutral face angle at address.

* * * * *